US007828571B2

(12) United States Patent
Satoh et al.

(10) Patent No.: US 7,828,571 B2
(45) Date of Patent: Nov. 9, 2010

(54) ELECTRICAL CONNECTOR HAVING LOCKING PROJECTIONS

(75) Inventors: Tomoyuki Satoh, Kanagawa (JP); Atsunobu Fukuoka, Kanagawa (JP)

(73) Assignee: Kyocera Elco Corporation (JP)

( * ) Notice: Subject to any disclaimer, the term of this patent is extended or adjusted under 35 U.S.C. 154(b) by 0 days.

(21) Appl. No.: 12/428,565

(22) Filed: Apr. 23, 2009

(65) Prior Publication Data

US 2009/0269986 A1 Oct. 29, 2009

(30) Foreign Application Priority Data

Apr. 23, 2008 (JP) ..... 2008-112119

(51) Int. Cl.
*H01R 13/15* (2006.01)

(52) U.S. Cl. ..... 439/260

(58) Field of Classification Search ..... 439/260–264, 439/494–496, 630

See application file for complete search history.

(56) References Cited

U.S. PATENT DOCUMENTS 7,044,773 B2 * 5/2006 Suzuki et al. ..... 439/495
7,311,542 B2 * 12/2007 Suzuki ..... 439/260
7,344,399 B2 * 3/2008 Iijima et al. ..... 439/260
7,494,366 B2 * 2/2009 Suzuki et al. ..... 439/495
7,563,128 B2 * 7/2009 Suzuki et al. ..... 439/495
2006/0183364 A1 * 8/2006 Suzuki et al. ..... 439/260

* cited by examiner

*Primary Examiner*—Chandrika Prasad
(74) *Attorney, Agent, or Firm*—McCormick, Paulding & Huber LLP

(57) ABSTRACT

A connector to which an object is to be connected, includes an insulator having at least one contact support groove, and at least one contact which is fixed to the insulator by being inserted into the contact support groove, the contact being contactable with the object after the object is inserted into the insulator. The insulator includes at least one holding portion formed as one of a recess and a through-hole, which is communicatively connected with the contact support groove, and the contact includes a locking protrusion, which comes into engagement with the holding portion to hold the contact to the insulator when the contact is inserted into the contact support groove.

9 Claims, 11 Drawing Sheets

ELECTRICAL CONNECTOR HAVING LOCKING PROJECTIONS

CROSS REFERENCE TO RELATED APPLICATION

The present invention is related to and claims priority of the following co-pending application, namely, Japanese Patent Application No. 2008-112119 filed on Apr. 23, 2008.

FIELD OF THE INVENTION

The present invention relates to a connector.

BACKGROUND OF THE INVENTION

The connector disclosed in Japanese Unexamined Patent Publication 2008-60087 is provided with a housing (insulator) having a plurality of contact support grooves (insertion grooves), a plurality of contacts which are respectively inserted into the plurality of contact support grooves by press-fitting, and a slider (actuator) supported by the housing.

Since a fixed portion in the shape of a projection projects from a side of each contact, inserting each contact into a corresponding contact support groove by press-fitting causes the fixed portion of this contact to be pressed against a side surface of associated one of a plurality of partition walls, defining the plurality of contact support grooves, to thereby be wedged into the side surface. Thereupon, a wedging force occurs between each fixed portion and the associated partition wall, thus preventing each contact from unexpectedly coming out of the associated contact support groove.

In recent years, there have been growing trends to miniaturize connectors and to narrow the pitch of contacts due to the recent trend of multi-contact design. Accordingly, in connectors produced in recent years, partition walls that form a plurality of contact support grooves therebetween are thin compared with those of conventional ones, thus becoming easy to deform plastically or elastically. If the partition walls are easily deformed, the fixed portion of each contact cannot be easily wedged into the associated partition wall, which reduces a holding force acting on the contact by the associated support groove (partition wall) to hold the contact therein.

Additionally, if each partition wall is thin, a stress applied to each partition wall which is caused by press-fitting the plurality of contacts into the corresponding plurality of contact support grooves cannot be sufficiently dispersed and thus remains, so that there is a possibility of the entire housing becoming warped. Specifically, if reflow soldering is performed when each contact is soldered to a circuit board, reflow heat is transmitted to the housing, so that there is a possibility of the housing becoming largely warped by the residual stress. This kind of warping of the housing becomes a cause of a failure in mounting of the contacts to the circuit board.

SUMMARY OF THE INVENTION

The present invention provides a connector, which is structured to be capable of firmly holding each contact to an insulator without deforming the insulator.

According to an aspect of the present invention, a connector is provided to which an object is to be connected, including an insulator having at least one contact support groove; and at least one contact which is fixed to the insulator by being inserted into the contact support groove, the contact being contactable with the object after the object is inserted into the insulator. The insulator includes at least one holding portion formed as one of a recess and a through-hole, which is communicatively connected with the contact support groove, and the contact includes a locking protrusion, which comes into engagement with the holding portion to hold the contact to the insulator when the contact is inserted into the contact support groove.

According to the present invention, the contact is firmly held by the insulator because the locking protrusion that protrudes from the contact is engaged with the holding portion that is formed of the insulator when the contact is inserted into the contact support groove of the insulator.

Moreover, the locking protrusion does not press the associated side surface in the contact support groove after the completion of the contact into the contact support groove of the insulator, and accordingly, the insulator is not subjected to mechanical stress, thus not being deformed thereby.

It is desirable for a plurality of the contact support grooves to be arranged in a predetermined direction, wherein a plurality of the contacts are inserted into the plurality of contact support grooves, respectively, a plurality of the holding portions are communicatively connected with the plurality of contact support grooves, respectively, and are provided at alternately different positions in a lengthwise direction of the plurality of contact support grooves to be arranged in a zigzag fashion, and the locking protrusion is formed on each of the contacts, so that the locking protrusions of the contacts come into engagement with the holding portions when the contacts are inserted into the contact support grooves, respectively. Accordingly, a reduction in mechanical strength of the insulator caused by the formation of the plurality of holding portions can be minimized compared with the case where the plurality of holding portions are formed to be arranged along on a given straight line. In addition, the flowability (moldability) of synthetic resin of the insulator when the insulator is molded by injection molding is enhanced.

It is desirable for the locking protrusion to protrude from one of two lateral sides of the contact, and for the holding portion to be formed on one of two lateral sides of the contact support groove, which faces the one lateral side of the contact.

If the locking protrusion is formed on a top surface of the second arm while the holding portion with which the locking protrusion is engaged is formed on a bottom surface (inner surface) of a top plate portion of the insulator, the second arm becomes immovable relative to the first arm. Therefore, even if the connector having this sort of structure is equipped with the actuator, the second arm cannot be moved by the actuator.

However, if an actuator, which moves one end of the second arm toward the inserted object by pressing the other end of the second arm in a direction away from an adjacent one end of the first arm with the object being inserted in between the other end of the first arm and the one end of the second arm, is applied to a connector which is structured so that the locking protrusion protrudes from one of two lateral sides of the contact and so that the holding portion is formed on one of two lateral sides of the contact support groove which faces the one lateral side of the contact, one end of the second arm can be moved by the actuator toward the object which is to be connected to the contact. Accordingly, through the use of this actuator, the first arm and the second arm can be reliably pressed against (can be connected to) the object to be connected.

It is desirable for a top surface of the locking protrusion to face a top surface of the holding portion while a bottom surface of the contact is in contact with a bottom of the contact support groove.

It is desirable for the locking protrusion to protrude from one of a top surface and a bottom surface of the contact, and for the holding portion to be formed on one of a top surface and a bottom surface of the contact support groove. Accordingly, the position of the contact relative to the insulator can be securely fixed.

It is desirable for an engaging portion to be formed on the contact at a position different from a position of the locking protrusion in a lengthwise direction of the connector, wherein a surface of the locking protrusion which faces the engaging portion faces an inner surface of the holding portion, and a surface of the engaging portion which faces the locking protrusion is in contact with the insulator. Accordingly, the contact can be securely prevented from deviating relative to the insulator in the lengthwise direction of the contact regardless of the insertion direction of the contact into the insulator.

It is desirable for the actuator to include at least one cam positioned between the adjacent end of the first arm and the other end of the second arm, a movement of the actuator relative to the insulator causing the cam to press the other end of the second arm to thereby move the one end of the second arm toward the other end of the first arm.

It is desirable for the actuator to include a pair of pivots which project in opposite directions from laterally opposite ends of the actuator, respectively, wherein the actuator is rotatable about the pair of pivots relative to the insulator.

In an embodiment, a connector is provided, including an insulator having a plurality of contact support grooves, and a plurality of contacts which are fixed to the insulator by being inserted into the plurality of contact support grooves, respectively, each of the contacts having two prongs for holding an object which is to be connected to the contact therebetween. The insulator includes a plurality of locking holes formed in the contact support grooves, respectively. Each of the contacts includes a locking protrusion which comes into engagement with the locking hole formed in associated one of the contact support grooves when the contacts are inserted into the contact support grooves, respectively.

BRIEF DESCRIPTION OF THE DRAWINGS

The present invention will be discussed below in detail with reference to the accompanying drawings, in which.

DESCRIPTION OF THE PREFERRED EMBODIMENTS

Figure 1:
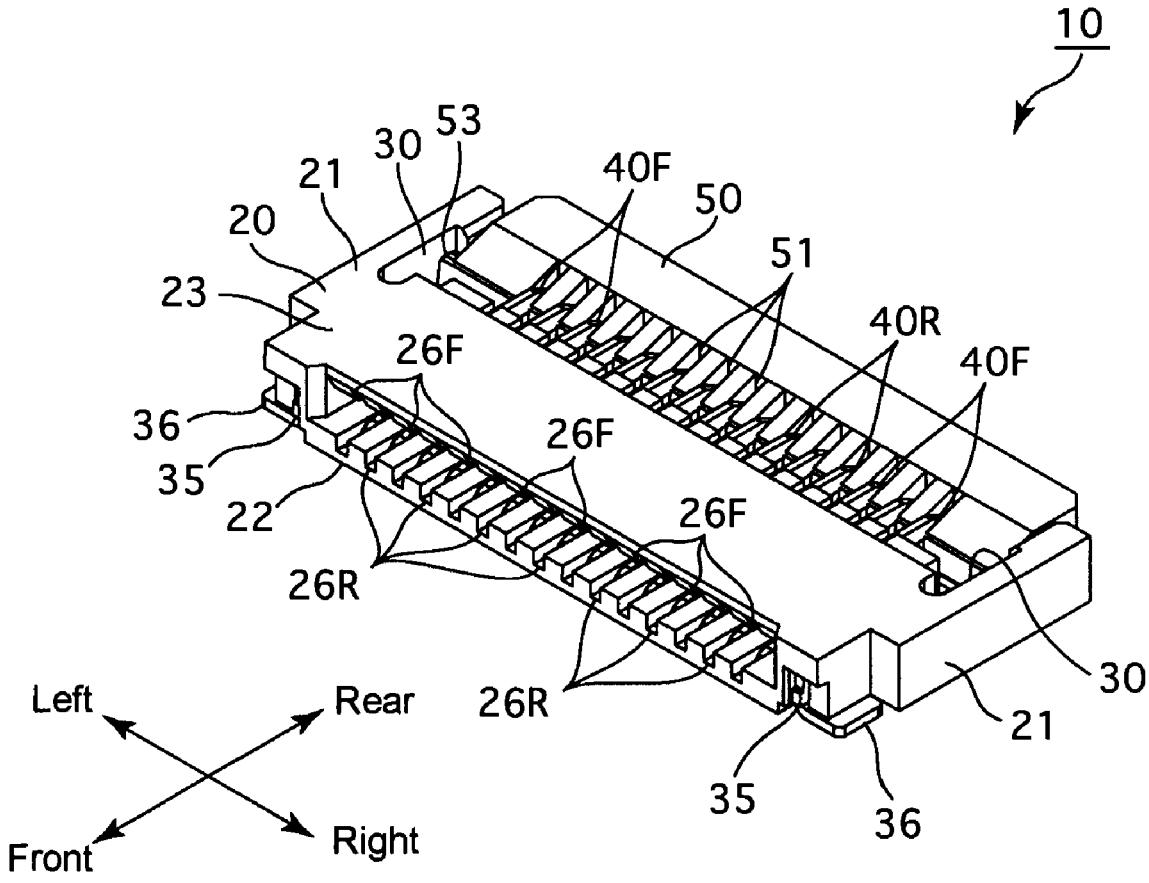
FIG. 1 is a front perspective view of an embodiment of a connector according to the present invention, viewed obliquely from above.
Figure 2:
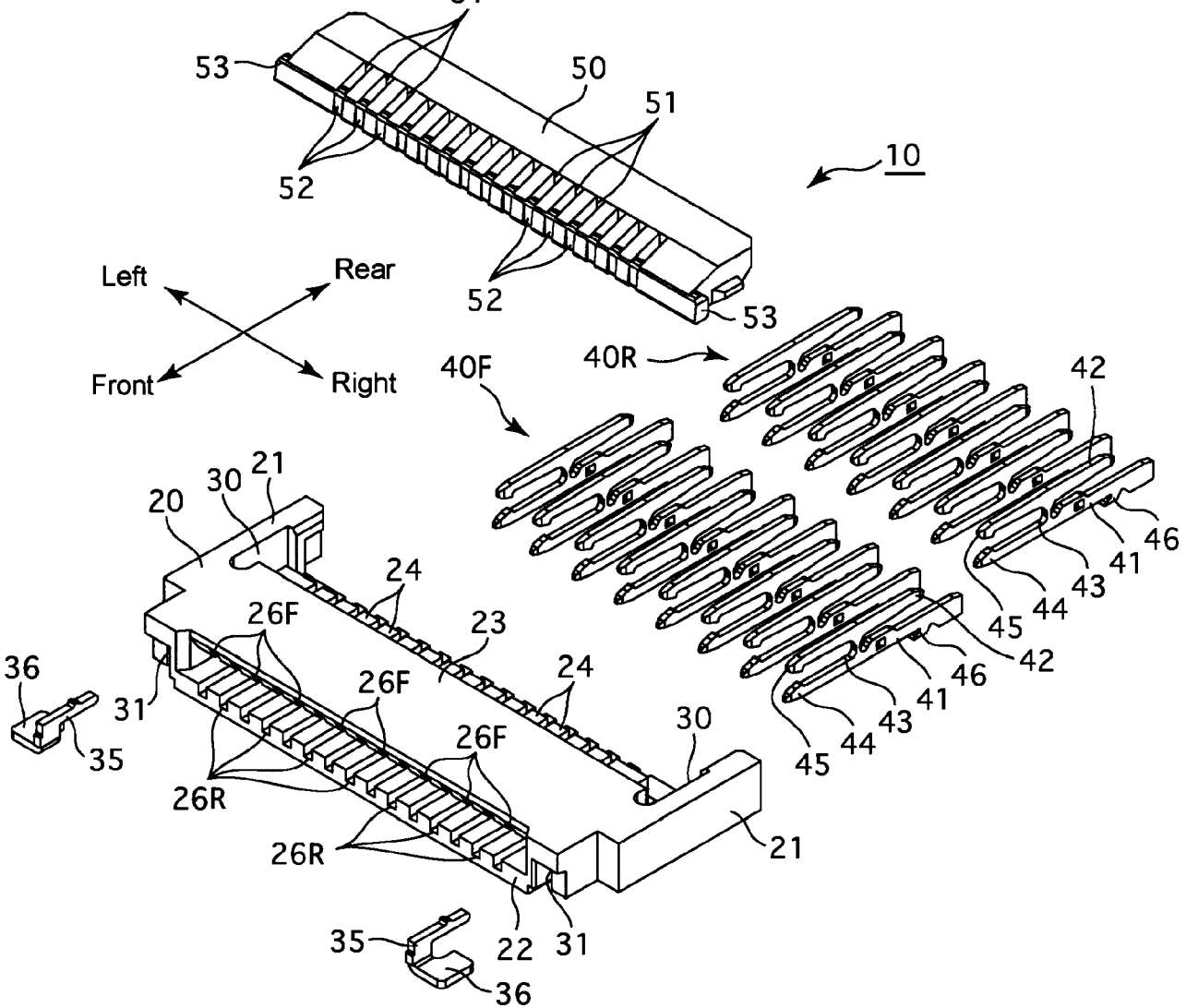
FIG. 2 is an exploded front perspective view of the connector, viewed obliquely from above.
Figure 3:
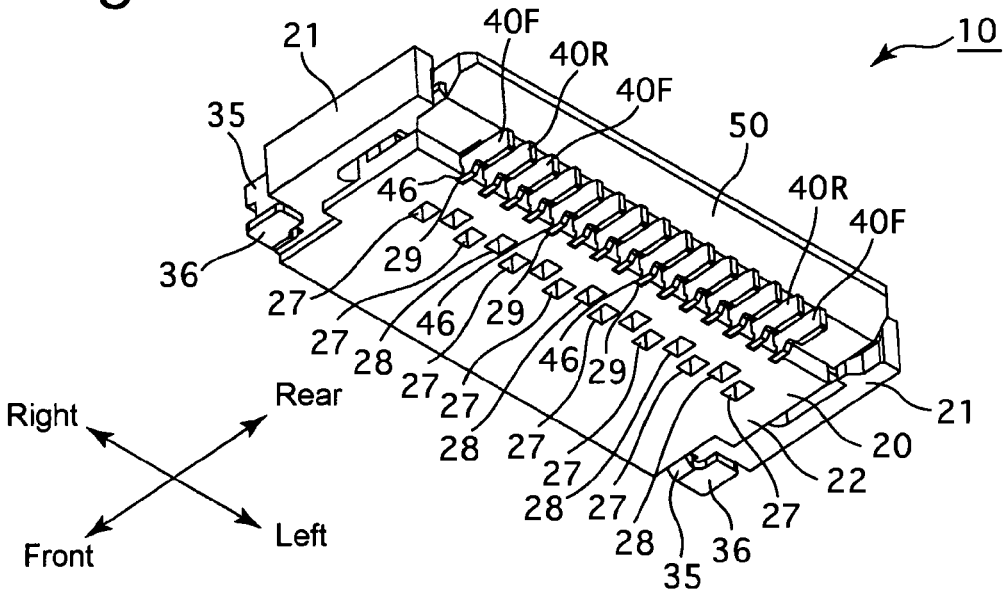
FIG. 3 is a rear perspective view of the connector, viewed obliquely from below.
Figure 4:
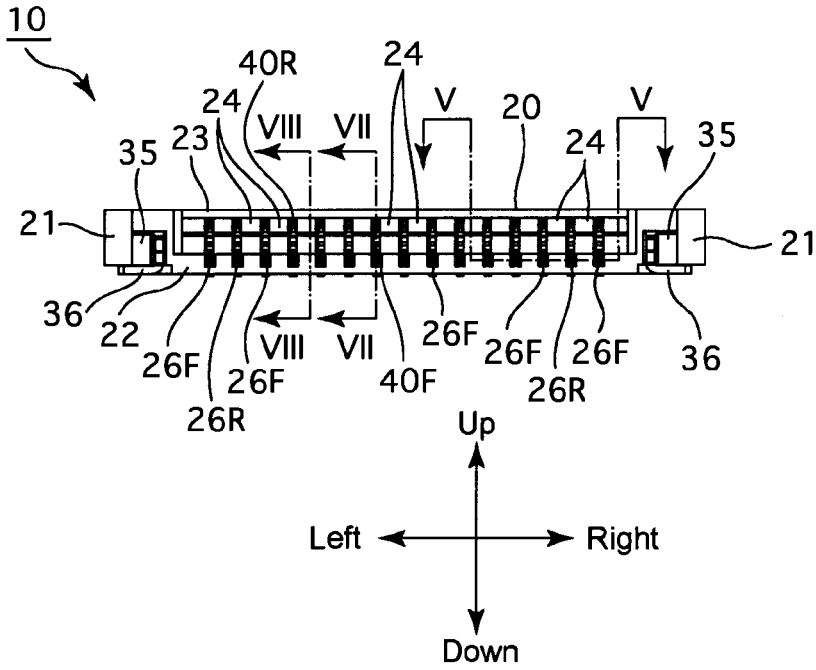
FIG. 4 is a front elevational view of the connector.

An embodiment of a connector according to the present invention will be hereinafter discussed with reference to FIGS. 1 through 10. In the following descriptions, forward and rearward directions, leftward and rightward directions, and upward and downward directions of the connector 10 are determined with reference to the directions of the double-headed arrows shown in the drawings.

The connector 10 is for use with a FPC (Flexible Printed Circuit). The connector 10 is provided, as relatively large elements thereof, with an insulator 20, two (left and right) anchors 35, a series of first contacts 40F, a series of second contacts 40R and a rotational actuator 50.

The insulator 20 is made of electrical-insulative and heat-resistant synthetic resin by injection molding. The insulator 20 is provided with a pair of (left and right) sidewall portions 21, a bottom plate portion 22 and a top plate portion 23. The bottom ends of the pair of side wall portions 21 are connected to each other via the bottom plate portion 22, and the top ends of front halves of the pair of side wall portions 21 are connected to each other via the top plate portion 23.

Figure 5:
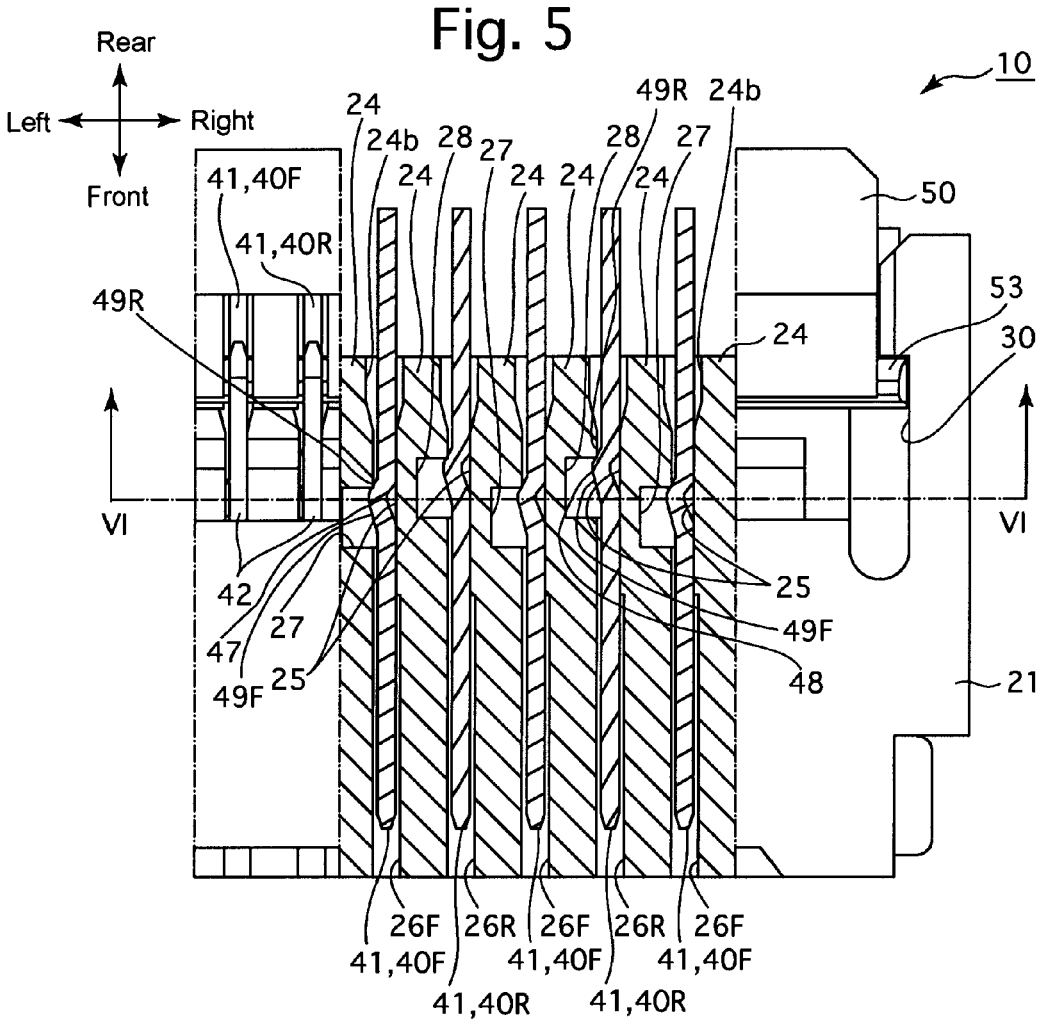
FIG. 5 is a cross sectional view taken along the line V-V shown in FIG. 4.
Figure 6:
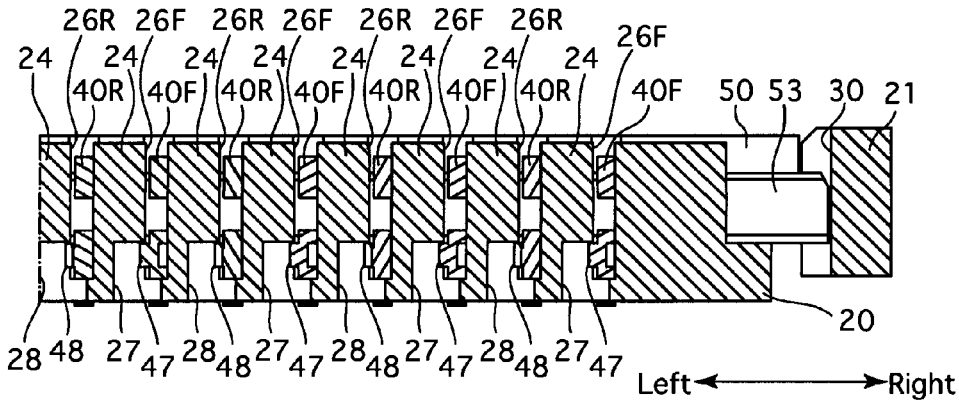
FIG. 6 is a cross sectional view taken along the line VI-VI shown in FIG. 5.

The insulator 20 is provided between the bottom plate portion 22 and the top plate portion 23 with a total of sixteen partition walls 24 which are formed integral with the insulator 20 and arranged at regular intervals in the leftward/rightward direction. Each partition wall 24 extends substantially in the vertical direction of the insulator 20 and is provided on the front of the partition wall 24 with an insertion recess 24*a*, which is recessed rearward (see FIGS. 7 through 9). The rear end of each partition wall 24 is positioned behind the rear end of the top plate portion 23 in the forward/rearward direction (see FIGS. 2 and 7 through 9). In addition, as shown in FIG. 5, a portion of the left side surface of each partition wall 24 in the area close to the rear end thereof protrudes leftward to be positioned to the left of the remaining portions (front and rear portions) of the same side surface in the leftward/rightward direction to serve as a flat support surface 25. Additionally, adjacent surfaces of the sixteen partition walls 24 in the leftward/rightward direction are provided in the vicinity of the rear ends of the partition walls 24 with guide recesses 24*b* for leading the series of first contacts 40F and the series of second contacts 40R into the insulator 20 when the series of first contacts 40F and the series of second contacts 40R are inserted into the insulator 20.

The connector 10 is provided between adjacent partition walls 24 with a total of eight first contact support grooves 26F and a total of seven-second contact support grooves 26R each of which is elongated in the forward/rearward direction. As shown in the drawings, the first contact support grooves 26F and the second contact support grooves 26R are alternately arranged. The bottom plate portion 22 is provided on a top surface thereof with a total of fifteen recessed grooves which are recessed downward and elongated in the forward/rearward direction to serve as the bottom ends of the first and second contact support grooves 26F and 26R, respectively, while the top plate portion 23 is provided on a lower surface (inner surface) thereof with a total of fifteen recessed grooves which are recessed upward and elongated in the forward/rearward direction to serve as the top ends of the first and second contact support grooves 26F and 26R, respectively.

As shown in FIGS. 3 and 5 through 9, the insulator 20 is provided with a total of fifteen locking holes (holding portions) 27 and 28, each of which is formed in a manner so that the bottom end of the right side surface of the associated partition wall 24 is recessed leftward and that a through-hole is formed through a portion of the bottom plate portion 22 which is communicatively connected with this recessed portion to extend vertically. As shown in the drawings, each locking hole 27 and each locking hole 28 are communicatively connected with the associated first contact support groove 26F and the associated second contact support groove 26R, respectively. The number of the locking holes 27 is eight and the number of the locking holes 28 is seven. The seven locking holes 28 are positioned behind the eight locking holes 27 in the forward/rearward direction.

The bottom plate portion 22 is provided, on portions of the bottom surface thereof at the rear end of this bottom surface with a total of fifteen locking recesses 29, at positions immediately below the rear ends of the fifteen contact support grooves (the eight first contact support grooves 26F and the seven second contact support grooves 26R), respectively. The left and right side wall portions 21 are provided at the rear thereof on inner side surfaces thereof with two (left and right) bearing recesses 30, respectively.

The insulator 20 is provided at the front ends of the left and right side wall portions 21 with two (left and right) anchor-receiving recesses 31, respectively, which are recessed rearward. Each anchor 35 is provided with a tail portion 36, which lies substantially horizontal. The rear ends of the left and right anchors 35 are fitted into the left and right anchor-receiving recesses 31 from the front thereof, respectively.

Each of the eight first contacts 40F and the seven second contacts 40R is molded of a thin base material made of a resilient copper alloy (e.g., phosphor bronze, beryllium copper, titanium copper) or a resilient Corson-copper alloy by stamping, and is coated with firstly nickel (Ni) plating as base plating and subsequently gold (Au) plating as finish plating.

As shown in the drawings, each of the eight first contacts 40F and the seven-second contacts 40R is in the shape of a letter H in side view and provided with a first arm (lower arm) 41, a second arm (upper arm) 42 and a resilient connecting portion 43. The first arm 41 and the second arm 42 are substantially parallel to each other with a predetermined distance therebetween, and the resilient connecting portion 43 connects middle portions of the first arm 41 and the second arm 42 to each other. The first arm 41 and the second arm 42 are provided at the front ends thereof with a contacting projection 44 and a contacting projection 45, respectively, which project toward each other to face each other. The first arm 41 is provided, on the bottom surface thereof in the vicinity of the rear end of the first arm 41, with a hook-shaped engaging portion 46.

Figure 9:
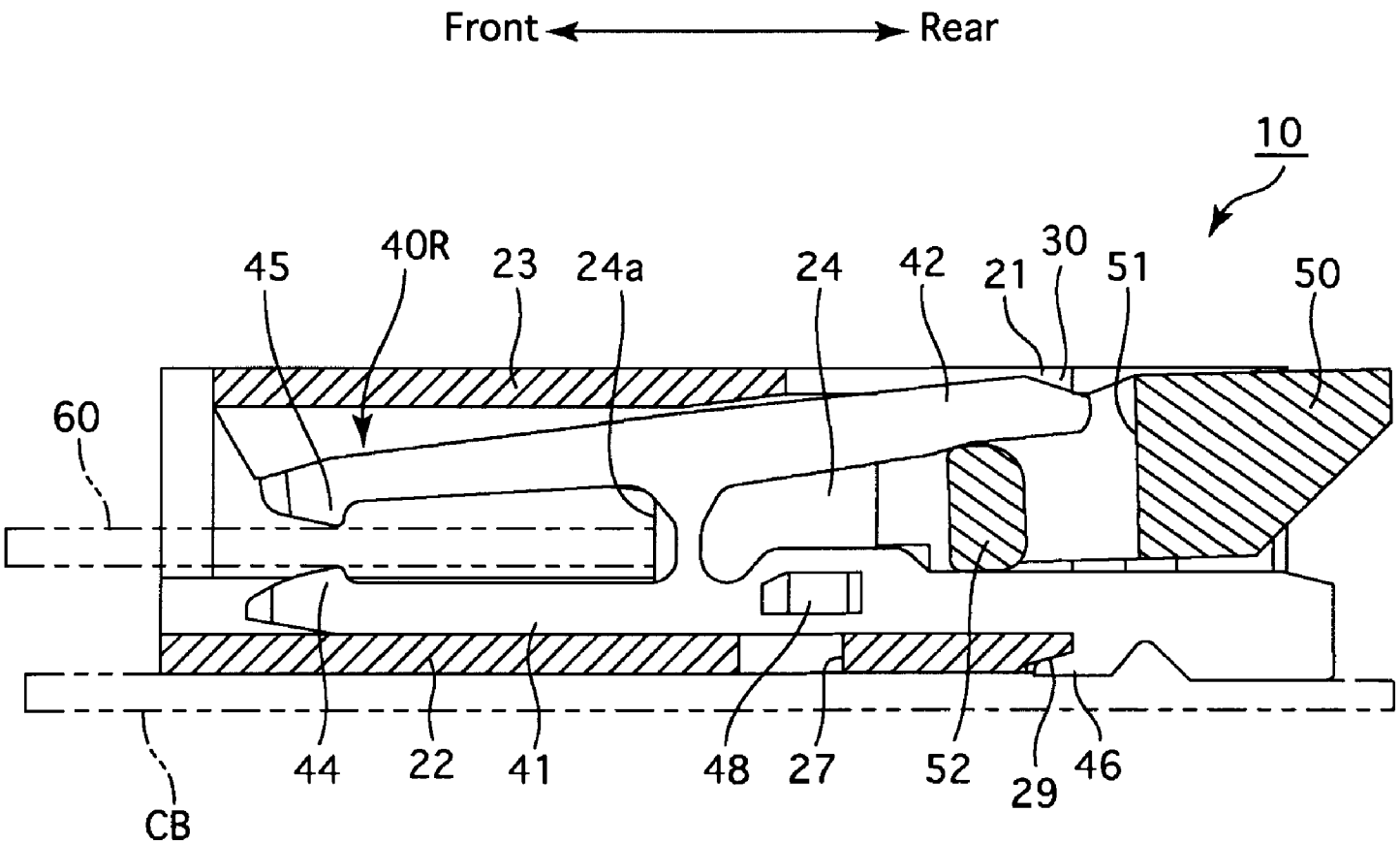
FIG. 9 is a cross sectional view similar to that of FIG. 8 when the rotational actuator is in a locked position.
Figure 10:
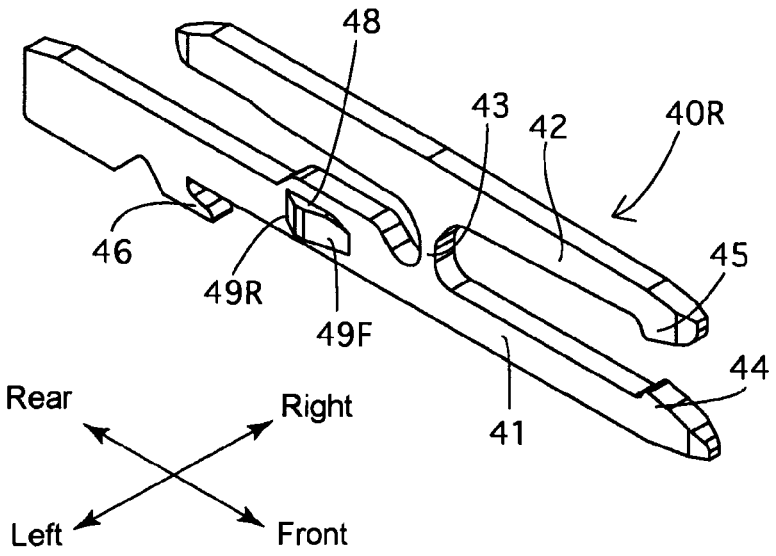
FIG. 10 is an enlarged front perspective view of a second contact, viewed obliquely from above.

Each first contact 40F is provided, on the left surface thereof, at an approximate center of this left surface, with a locking protrusion 47 which protrudes leftward, and each second contact 40R is provided, on the left surface thereof at an approximate center of this left surface, with a locking protrusion 48 which protrudes leftward. The locking protrusions 47 and 48 are respectively formed on the first and second contacts 40F and 40R by indenting the right side surfaces of the of first and second contacts 40F and 40R in the leftward direction. As shown in FIGS. 5 and 9, the locking protrusion 47 of each first contact 40F is provided with a front inclined surface 49F and a rear inclined surface 49R positioned behind the front inclined surface 49F. Likewise, as shown in FIG. 10, the locking protrusion 48 of each second contact 40R is provided with a front inclined surface 49F and a rear inclined surface 49R positioned behind the front inclined surface 49F. As shown in FIG. 5, the locking protrusions 47 on the eight first contacts 40F are positioned closer to the front of the insulator 10 than the locking protrusions 48 on the seven-second contacts 40R in the forward/rearward direction.

The eight first contacts 40F are inserted into the eight first contact support grooves 26F from the rear, respectively, while the seven second contacts 40R are inserted into the seven second contact support grooves 26R from the rear, respectively.

Figure 7:
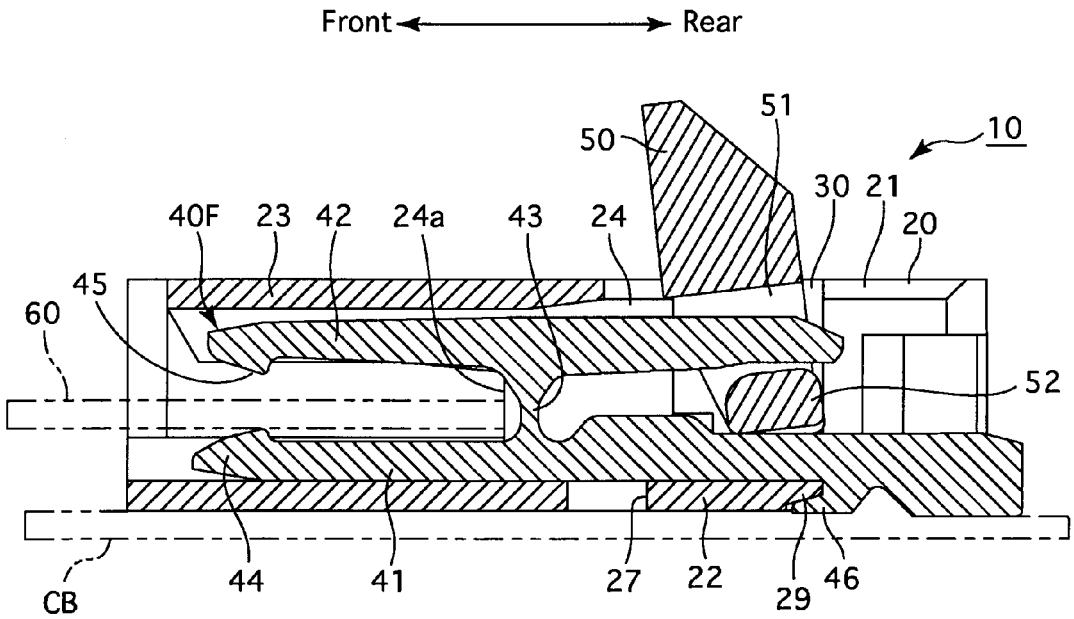
FIG. 7 is a cross sectional view taken along the line VII-VII shown in FIG. 5 when the rotational actuator is in an unlocked position.

As shown in FIG. 7, upon each first contact 40F being inserted into the associated contact support groove 26F, the bottom surface of the first arm 41 comes in contact with the bottom of the associated first contact support groove 26F (the bottom of the associated recessed groove formed on the bottom plate portion 22), the top surface of the second arm 42 is a certain distance apart downwardly from the top surface of the associated first contact support groove 26F (the top surface of the associated recessed groove formed on the top plate portion 23), and the locking protrusion 47 of the first contact 40F is engaged in the associated locking hole 27. Thereupon, the rear inclined surface 49R of the locking protrusion 47 comes in contact with a rear edge of the associated locking hole 27, while the hook-shaped engaging portion 46 of the first contact 40F is engaged in the associated locking recess 29 of the insulator 20 (see FIGS. 3 and 7 through 9), and accordingly, each first contact 40F inserted into the associated first contact support groove 26F becomes securely fitted therein in the forward/rearward direction. Additionally, the rear inclined surface 49R of the locking protrusion 47 of each first contact 40F comes in contact with a rear edge of the associated locking hole 27 as noted above while the right side surface of the first contact 40F comes in contact with the support flat surface 25 of the associated partition wall 24 as shown in FIG. 5, and accordingly, each first contact 40F inserted into the associated first contact support groove 26F becomes securely fitted therein in the leftward/rightward direction either. Additionally, the bottom surface of each first arm 41 comes in contact with the bottom of the associated first contact support groove 26F as noted above while the top surface of the locking protrusion 47 comes in contact with the top surface of the associated locking hole 27 (see FIG. 6), and accordingly, each first contact 40F inserted into the associated first contact support groove 26F becomes securely fitted therein in the upward/downward direction either.

Figure 8:
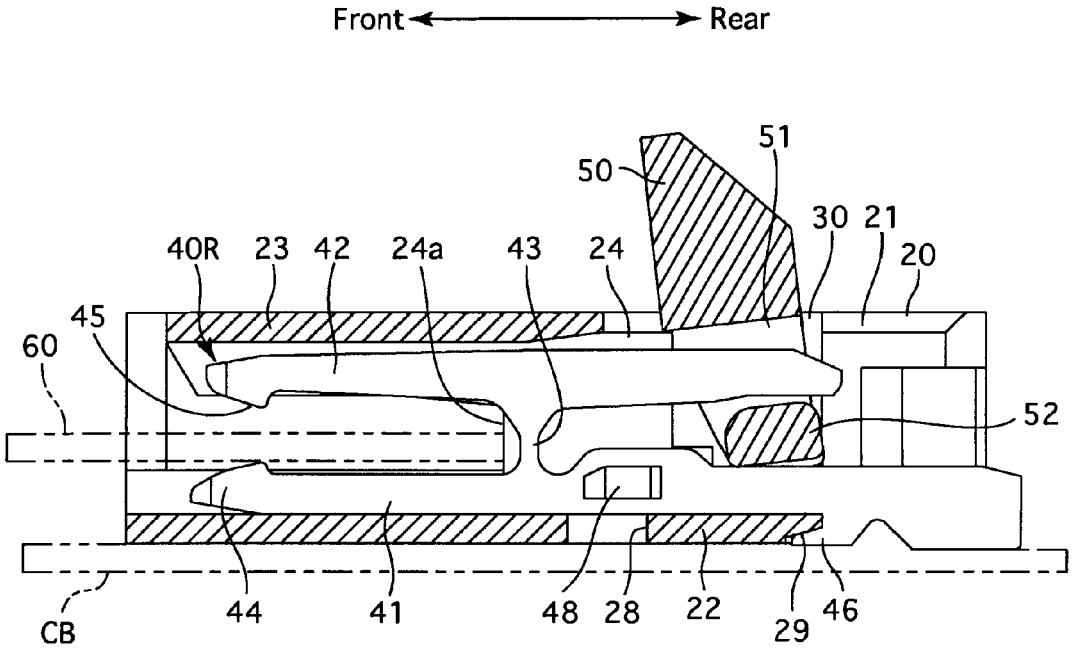
FIG. 8 is a cross sectional view taken along the line VIII-VIII shown in FIG. 5 when the rotational actuator is in the unlocked position.

Likewise, as shown in FIGS. 8 and 9, upon each second contact 40R being inserted into the associated contact support groove 26R, the bottom surface of the first arm 41 comes in contact with the bottom of the associated second contact support groove 26R (the bottom of the associated recessed groove formed on the bottom plate portion 22), and the top surface of the second arm 42 is a certain distance apart downwardly from the top surface of the associated first contact support groove 26R (the top surface of the associated recessed groove formed on the top plate portion 23). Thereupon, the locking protrusion 48 of the second contact 40R is engaged in the associated locking hole 28, and thereafter, the rear inclined surface 49R of the locking protrusion 48 comes in contact with a rear edge of the associated locking hole 28 while the hook-shaped engaging portion 46 of the second contact 40R is engaged in the associated locking recess 29. Additionally, the right side surface of the second contact 40R comes in contact with the support flat surface 25 of the associated partition wall 24, the bottom surface of each first arm 41 of the second contact 40R comes in contact with the bottom of the associated second contact support groove 26R, and the top surface of the locking protrusion 48 of the second contact 40R comes in contact with the top surface of the associated locking hole 28. Accordingly, each second contact 40R inserted into the associated second contact support groove 26R becomes securely fitted therein in each of the forward/rearward direction, the leftward/rightward direction and the upward/downward direction.

As shown in FIG. 5, the front portions of the first and second contacts 40F and 40R are not in contact with either a front portion of the adjacent left side surface which is positioned in front of the support surface 25 or a front portion of the adjacent right side surface of the associated left and right partition walls 24 in the associated first and second contact support grooves 26F and 26R, respectively. Due to this structure, the first and second arms 41 and 42 of each first contact 40F and the first and second arms 41 and 42 of each second contact 40R can be resiliently deformed inside the associated first contact support groove 26F and the associated second contact support groove 26R, respectively.

The rotational actuator 50 is a plate member extending in the leftward/rightward direction and molded out of a heat-resistant synthetic resin by injection molding. The rotational actuator 50 is provided with a total of fifteen through-holes 51 which are arranged at regular intervals in the leftward/rightward direction and each of which is formed through the rotational actuator 50 in the forward/rearward direction. The rotational actuator 50 is provided immediately below the fifteen through-holes 51 with fifteen cam portions 52, respectively, each of which is approximately rectangular in cross sectional shape. Additionally, the rotational actuator 50 is provided, at each of the left and right side surfaces thereof close to each end of the rotational actuator 50 with a pair of (left and right) pivots 53 which project in opposite directions away from each other in the leftward/rightward direction to be substantially coaxial with the fifteen cam portions 52.

The rotational actuator 50 that has the above described structure is pivoted on the insulator 20 to be rotatable about the left and right pivots 53 with the left and right pivots 53 being engaged into the left and right bearing recesses 30 formed in the left and right side wall portions 21 of the insulator 20, respectively (see FIGS. 5 and 6), and with the rear ends of the second arms 42 of the eight first contacts 40F and the seven second contacts 40R being inserted into the fifteen through-holes 51, respectively. The rotational actuator 50 is rotatable between an unlocked position shown in FIGS. 7 and 8, in which the rotational actuator 50 stands substantially vertical, and a locked position shown in FIG. 9, in which the rotational actuator 50 lies substantially horizontal.

In order to mount the connector 10 that has the above described structure onto a top surface of a circuit board CB (see FIGS. 7 through 9), firstly solder paste is applied between the rear ends (tail portions) of the first arms 41 of each first contact 40F and each second contact 40R and a circuit pattern (not shown) formed on the top surface of the circuit board CB, and soldering paste is applied between the tail portions 36 of the left and right anchors 35 and a ground pattern (not shown) formed on the top surface of the circuit board CB, and subsequently, each solder paste is melted by heat in a reflow furnace. Thereupon, the rear ends of the first arms 41 of each first contact 40F and each second contact 40R are soldered to the aforementioned circuit pattern while the left and right tail portions 36 are soldered to the aforementioned ground pattern, which completes the mounting of the connector 10 to the circuit board CB.

Thereafter, as shown in FIGS. 7 through 9, upon an end of an FPC (object to be connected to each first contact 40F and each second contact 40R) 60 being inserted in between the bottom plate portion 22 and the top plate portion 23 from the front of the insulator 20 of the connector 10 that has been fixed integrally with the circuit board CB, a rear portion of the FPC 60 is positioned between the front portion of the first arm 41 and the second portion of the second arm 42 of each first contact 40F and of each second contact 40R, and simultaneously positioned in the insertion recess 24*a* of each partition wall 24.

Rotating the rotational actuator 50 to the locked position shown in FIG. 9 causes each cam portion 52 to press the bottom rear surface of the associated second arm 42 upwardly, thus causing the resilient connecting portions 43 of each first contact 40F and each second contact 40R to be resiliently deformed so that the second arms 42 of each first contact 40F and each second contact 40R rotate counterclockwise about the resilient connecting portions 43. Consequently, each contacting projection 45 comes in contact with a circuit pattern formed on the upper surface of the FPC 60, and furthermore, the contacting pressure of each contacting projection 44 against a circuit pattern formed on the lower surface of the FPC 60 increases, and accordingly, each first contact 40F and each second contact 40R are reliably electrically connected to the FPC 60.

As described above, according to the above illustrated embodiment of the connector, since the locking protrusion 47 of each first contact 40F and the locking protrusion 48 of each second contact 40R are engaged in the associated locking hole 27 and the associated locking hole 28 upon each first contact 40F and each second contact 40R being inserted into the associated contact support groove 26F and the associated contact support groove 26R, respectively, each first contact 40F and each second contact 40R are firmly prevented from coming off the associated first contact support groove 26F and the associated second contact support groove 26R, respectively.

Moreover, there is no possibility of the insulator 20 becoming warped by an assembling operation for the connector 10 even if the locking protrusion 47 of each first contact 40F and the locking protrusion 48 of each second contact 40R are engaged in the associated locking hole 27 and the associated locking hole 28, respectively, since no stress is applied to each partition wall 24 by either each locking protrusion 47 or each locking protrusion 48. Furthermore, even if reflow heat is transmitted to the insulator 20 when reflow soldering is performed, warping or the like which may be caused by residual stress does not occur. Accordingly, the connector 10 can be easily mounted onto the circuit board CB and neither the holding force for holding each first contact 40F by the associated locking hole 27 nor the holding force for holding each second contact 40R by the associated locking hole 28 deteriorates.

If the eight locking holes 27 and the seven locking holes 28 are formed on top surfaces of the fifteen recessed grooves formed on a bottom surface (inner surface) of the top plate portion 23, respectively, and if the locking protrusions 47 of the eight first contacts 40F and the seven locking protrusions 48 of the seven second contacts 40R that are respectively engaged in the eight locking holes 27 and the seven locking holes 28 are formed on top surfaces of the second arms 42 of the eight first contacts 40F and top surfaces of the second arms 42 of the seven second contacts 40R, respectively, the second arm 42 of neither each first contact 40F nor each second contact 40R can rotate even if the rotational actuator 50 is operated. However, in the case where each first contact 40F is provided on a lateral side of the first arm 41 thereof with a locking protrusion 47 while each second contact 40R is provided on a lateral side of the first arm 41 thereof with a locking protrusion 48 as disclosed in the above described embodiment of the connector 10, the second arm 42 is not prevented from rotating.

As shown in FIG. 5, the locking protrusions 47 (the locking holes 27) of the eight first contacts 40F and the locking protrusions 48 (the locking holes 28) of the seven second contacts 40R are provided at mutually different positions in the forward/rearward direction (to be arranged in a zigzag fashion), and accordingly, loads can be prevented from being exerted on the fifteen partition walls 24 at the same positions thereon in the lengthwise direction thereof, respectively, when the eight first contacts 40F and the seven second contacts 40R are installed to the insulator 20. In addition, if only the eight first contacts 40F, the locking holes 27 (engaging objects) of which are positioned closer to the front of the insulator 20 than the locking holes 28 of the seven second contacts 40R in the contact insertion direction (which corresponds to the forward/rearward direction), are firstly installed into the insulator 20 and subsequently the seven second contacts 40R, the locking holes 28 (engaging objects) of which are positioned closer to the rear of the insulator 20 than the locking holes 27 of the eight first contacts 40F in the contact insertion direction, are installed into the insulator 20, loads exerted on the insulator 20 when the eight first contacts 40F and the seven second contacts 40R are installed to the insulator 20 can further be reduced. Additionally, if thin-walled portions (portions in which the locking holes 27 and 28 are formed) are formed on the fifteen partition walls 24 at the same positions thereon in the lengthwise direction thereof, such portions of the insulator 20 substantially decrease in strength, and the flowability (moldability) of synthetic resin of the insulator 20 deteriorates when the insulator is molded by injection molding. However, in the above-described embodiment of the connector, this kind of problem does not occur since the positions of such thin-walled portions of the fifteen partition walls 24 in the lengthwise direction are separated into two different positions in the same lengthwise direction as clearly shown in FIG. 5.

Although the present invention has been described based on the above-illustrated embodiment of the connector, the present invention is not limited solely to this particular embodiment; making various modifications to the above-illustrated embodiment of the connector is possible.

Figure 11:
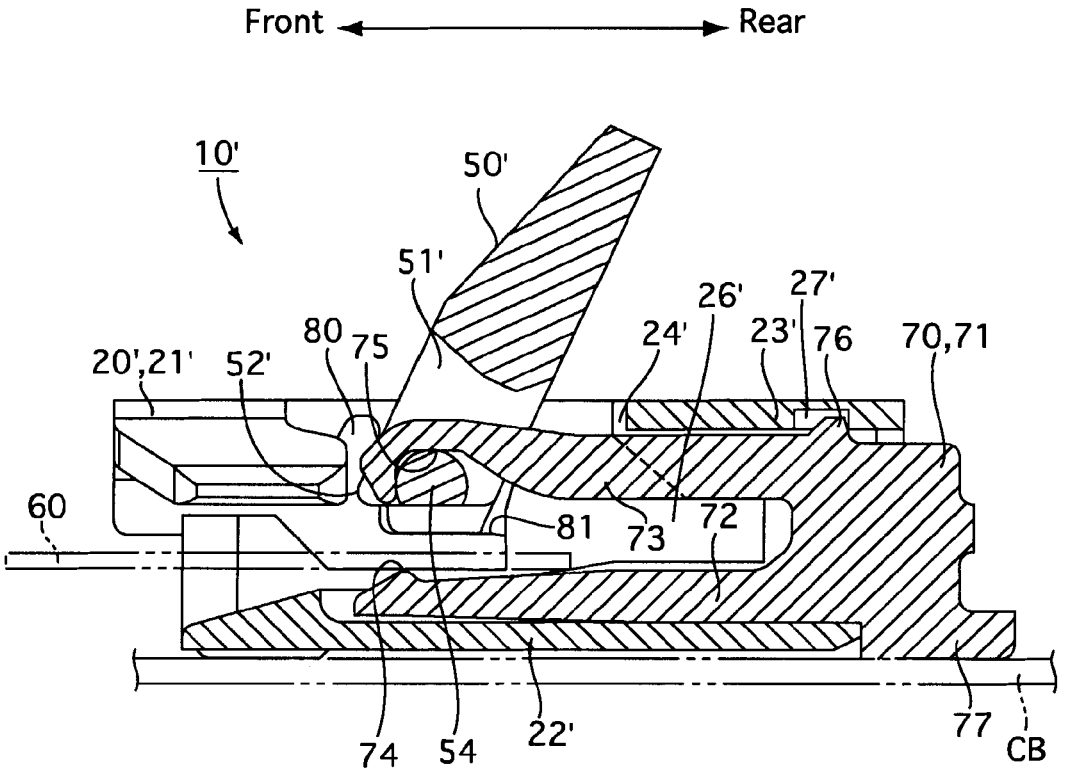
FIG. 11 is a cross sectional view similar to that of FIG. 7, showing a modified embodiment of the connector.

For instance, a modified embodiment of the connector shown in FIG. 11 is also possible. The connector 10' is provided with an insulator 20', a plurality of contacts 70, a rotational actuator 50' and a pair of anchors 80. The pair of anchors 80 are fixed to left and right ends of an internal space within the insulator 20', respectively.

The insulator 20' is provided with a pair of (left and right) side wall portions 21', a bottom plate portion 22', a top plate portion 23' and a plurality of partition walls 24'. The plurality of contacts 70 are inserted into a corresponding plurality of contact support grooves 26' which are formed as separate spaces between the plurality of partition walls 24', respectively. The rotational actuator 50' is provided with a plurality of through-holes 51', a plurality of cam portions 52', a pair of pivots and a plurality of rotational engaging portions 54. The plurality of cam portions 52' are formed at the lower end (base end) of the rotational actuator 50' and are identical in number to the through-holes 51'. The plurality of rotational engaging portions 54 are identical in number to the plurality of through-holes 51' and formed at positions corresponding to the positions of the cam portions 52 of the rotational actuator 50.

As shown in FIG. 11, each contact 70 is provided with a base portion 71, a first arm 72 and a second arm 73. The first arm 72 and the second arm 73 extend forward from the base portion 71. The first arm 72 of each contact 70 is provided at the front end thereof with a contacting projection 74 which projects upward, and the second arm 73 of each contact 70 is provided, on a bottom surface thereof in the vicinity of a front end of the second arm 73, with an engaging recess 75. The aforementioned pair of (left and right) pivots (not shown) of the rotational actuator 50' are positioned on a support surface 81 formed on the rear top surfaces of the pair of anchors 80 to be supported thereby, respectively, and the second arm 73 of each contact 70 passes through the associated through-hole 51' of the rotational actuator 50' so that the associated rotational engaging portion 54 engages with the engaging recess 75 of second arm 73.

If the FPC 60 is inserted into the connector 10' when the rotational actuator 50' is in an unlocked position shown in FIG. 11, in which the rotational actuator 50' stands substantially vertical, a circuit pattern formed on a lower surface of the FPC 60 comes in contact with the contacting projection 74 of the first arm 72 of each contact 70. Thereafter, rotating the rotational actuator 50' forward to the locked position (not shown), in which the rotational actuator 50' lies substantially horizontal, causes each cam portion 52' that is formed on the lower end (base end) of the rotating actuator 50' to be pressed against an upper surface of the FPC 60, thus causing the contacting pressure of the contacting projection 74 of each first arm 72 against the aforementioned circuit pattern on the lower surface of the FPC 60 to increase, and accordingly, the first arm 72 of each contact 70 is reliably electrically connected to the FPC 60.

The top plate portion 23 of the connector 10 is provided, on a lower surface thereof in the vicinity of the rear end of the top plate portion 23, with a plurality of locking holes (holding portions) 27' formed as bottomed holes which are arranged at regular intervals in the leftward/rightward direction (wherein the plurality of locking holes 27' are provided at alternately different positions in the forward/rearward direction to be arranged in a zigzag fashion). In addition, the base portions 71 of the plurality of contacts 70 are provided on top surfaces thereof with a plurality of engaging projections 76 which are engaged with the plurality of locking holes 27', respectively (the plurality of engaging projections 76 of the plurality of contacts 70 are provided at alternately different positions in the forward/rearward direction to correspond to the positions of the plurality of locking holes 27', respectively).

As shown in FIG. 11, in the modified embodiment of the connector 10', the locking protrusion 76 of each contact 70 is provided at the rear end thereof with a rear inclined surface, and this rear inclined surface is in contact with a rear edge of the associated locking hole 27', while the front of a tail portion 77 (portion to be soldered to a circuit pattern formed on an upper surface of the circuit board CB) which projects from the rear end of the bottom surface of each contact 70 is in contact with the rear end surface of the bottom plate portion 22' of the insulator 20', and accordingly, each contact 70 inserted into the associated contact support groove 26' becomes securely fitted therein in the forward/rearward direction relative to the insulator 20'.

It is possible for the locking protrusion 76 of each contact 70 to be formed on a bottom surface thereof, for the plurality of locking holes 27' to be formed on the bottom plate portion 22', and for the top surface of each contact 70 to be brought into contact with a lower surface (inner surface) of the top plate portion 23'.

Figure 12:
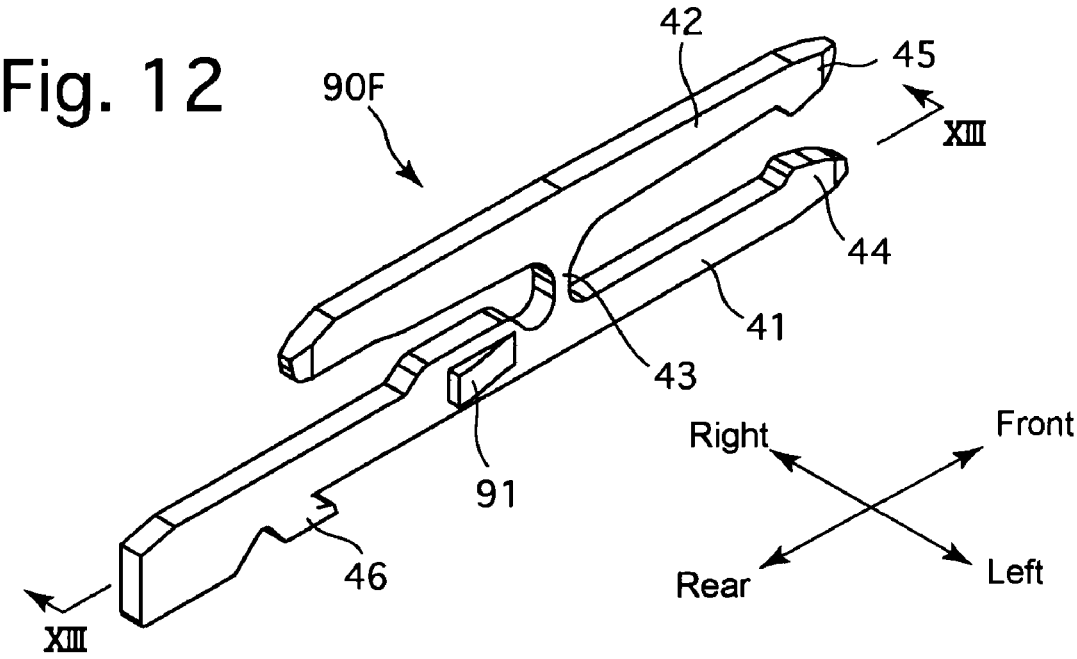
FIG. 12 is an enlarged rear perspective view of a first contact of another modified embodiment of the connector, viewed obliquely from above.
Figure 13:
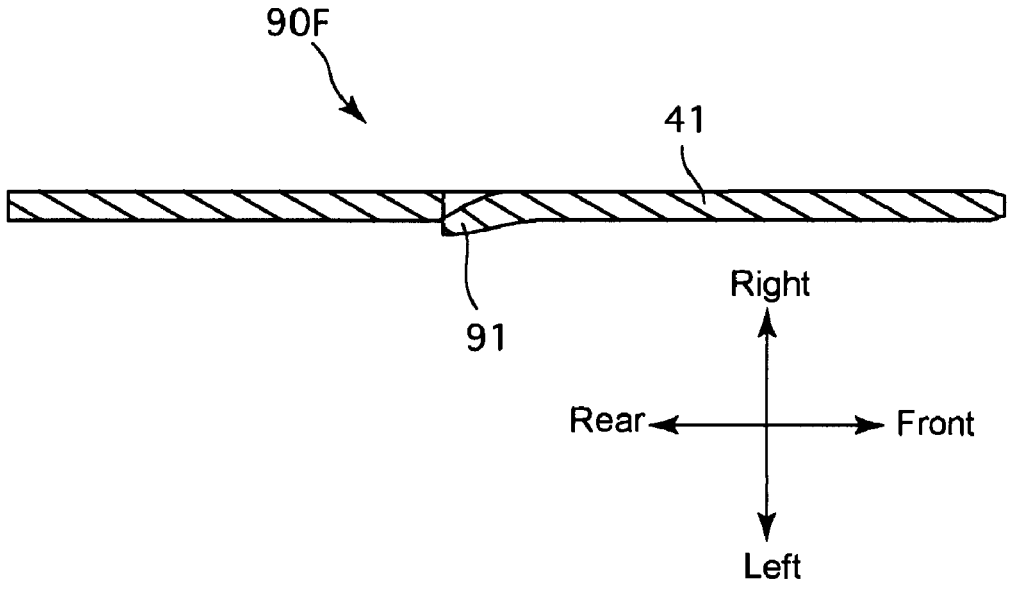
FIG. 13 is a cross sectional view taken along the line XIII-XIII shown in FIG. 12.

As shown in FIGS. 12 and 13, the rear end surface of a locking protrusion 91 provided on a first contact 90F can be formed as a flat surface orthogonal to the lengthwise direction of the first contact 90F, rather than being formed as an inclined surface. In this case, upon the first contact 90F being inserted into the associated first contact support groove 26F, the rear end surface (flat surface) of the locking protrusion 91 comes in contact with the rear surface of the associated locking hole 27.

Figure 14:
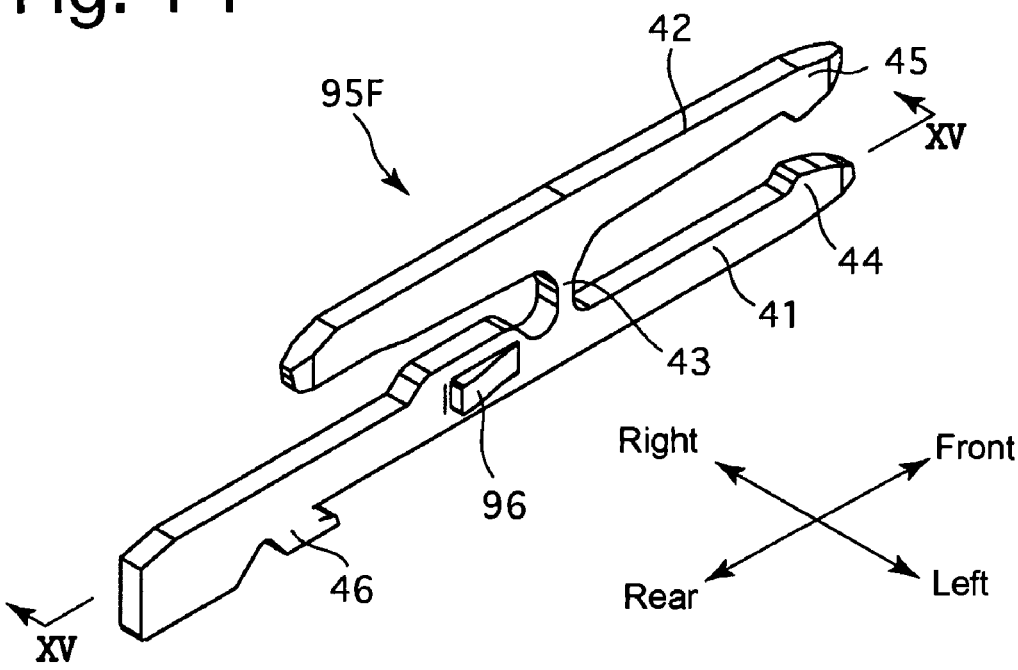
FIG. 14 is an enlarged rear perspective view of a first contact of yet another modified embodiment of the connector, viewed obliquely from above.
Figure 15:
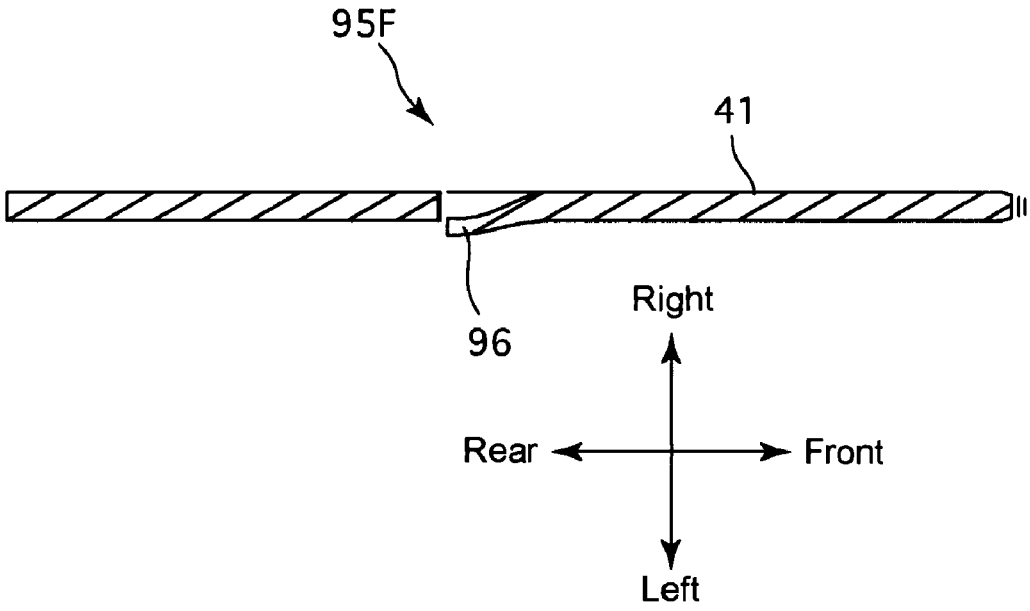
FIG. 15 is a cross sectional view taken along the line XV-XV shown in FIG. 14.

As shown in FIGS. 14 and 15, a locking projection 96 provided on a first contact 95F can be formed into a cut-and-raised portion so as to be resiliently deformable. In this case, in an assembling process (process of inserting the first contact 95F into the associated first contact support groove 26F), the locking projection 96 is resiliently deformed by coming into contact with a side surface of the associated first contact support groove 26F, and upon the first contact 95F being inserted into the associated first contact support groove 26F to a predetermined position, the locking projection 96 snaps into the associated locking hole 27 by resiliently returning to the original shape.

The modified embodiments shown in FIGS. 12 through 15 are also applicable to each second contact.

Figure 16:
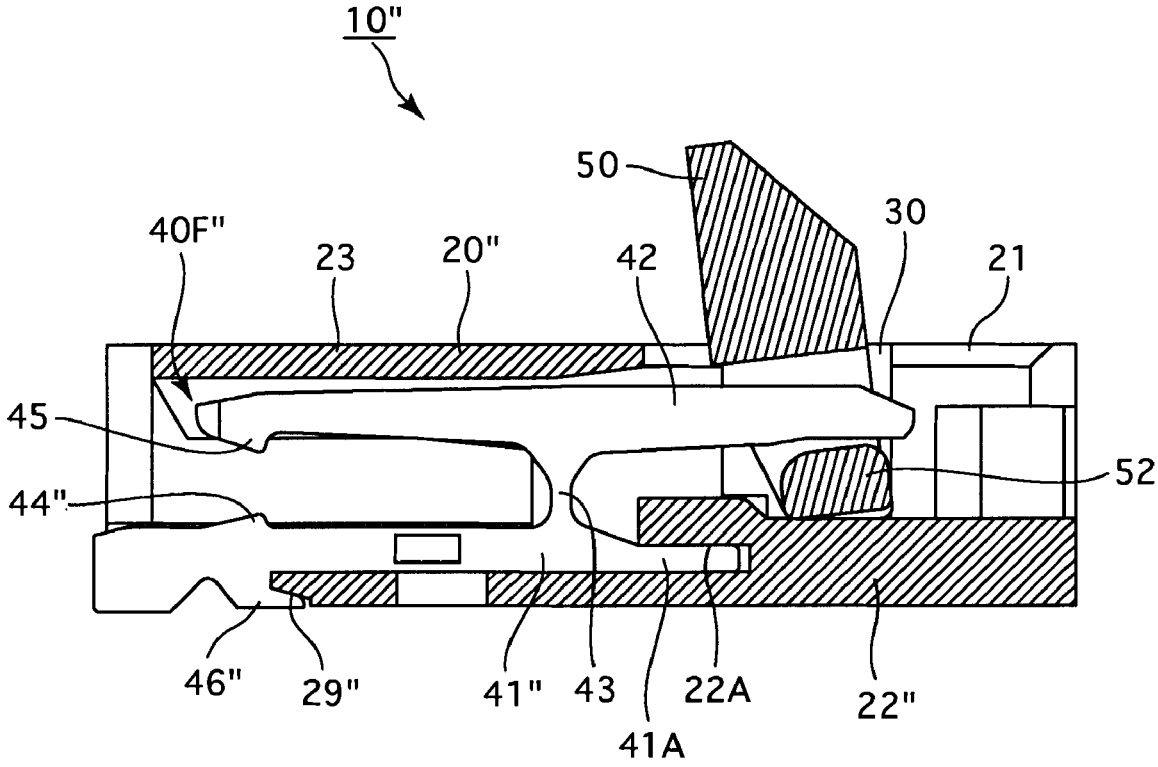
FIG. 16 is a cross sectional view similar to that of FIG. 7, showing yet another modified embodiment of the connector.
Figure 17:
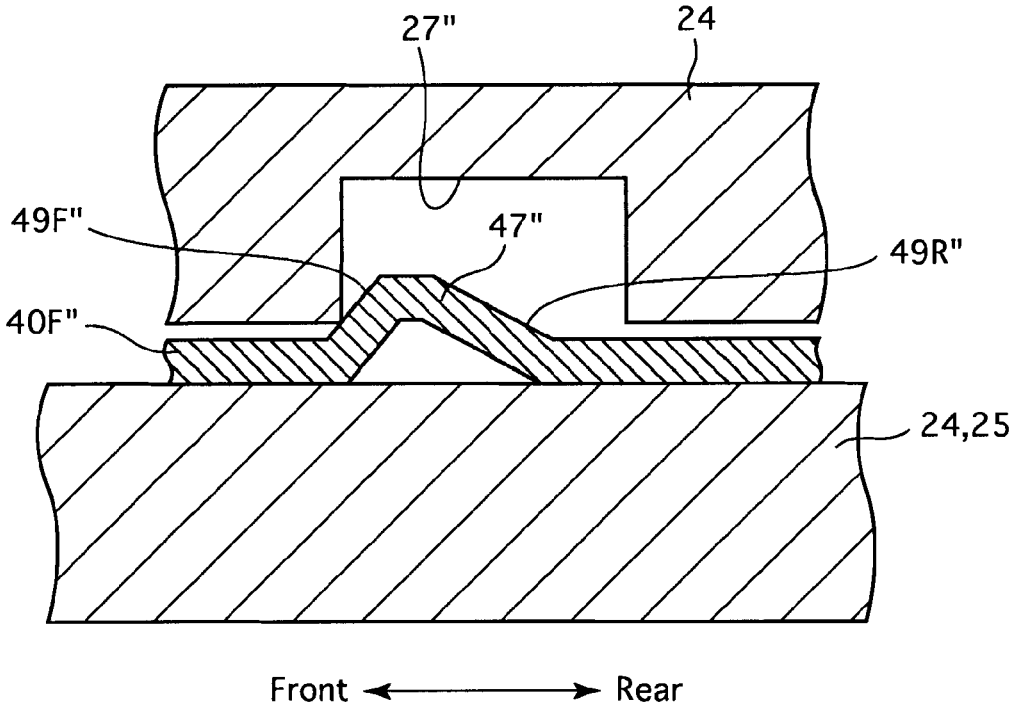
FIG. 17 is an enlarged cross sectional view of a portion of the embodiment of the connector shown in FIG. 16, showing a state of engagement between a locking protrusion and the associated locking hole.

As shown in FIGS. 16 and 17, a connector 10" having a structure such that each first contact 40F" is installed into an insulator 20" from front, is also possible.

A bottom plate portion 22" of the insulator 20" is provided, on portions of a front edge of the bottom plate portion 22" which face the plurality of first contacts 40F", with a plurality of locking recesses 29", respectively, and is further provided with a corresponding plurality of engaging recesses 22A.

Each first contact 40F" is provided with a first arm 41", a second arm 42 and a resilient connecting portion 43. The first arm 41" is provided, on the bottom surface thereof in the vicinity of the front end of the first arm 41", with a hook-shaped engaging portion 46" which is engaged with an associated locking recess 29", and is provided at the rear end of the first arm 41" with an engaging projection 41A which is engaged in an associated engaging recess 22A.

The structure of the remainder of the connector 10" is identical to the structure of the connector 10, so that each second contact 40R is inserted into the insulator 20" from rear in a similar manner to the connector 10.

As shown in FIG. 17, a locking protrusion 47" which protrudes from the left side surface of each first contact 40F" is provided with a front inclined surface 49F" and a rear inclined surface 49R", and the front inclined surface 49F" is in contact with a front edge (left edge with respect to FIG. 17) of the associated locking hole 27". In addition, although not shown in the drawings, the top surface of the locking protrusion 47" of each first contact 40F" is in contact with the top surface of the associated locking hole 27".

Figure 18:
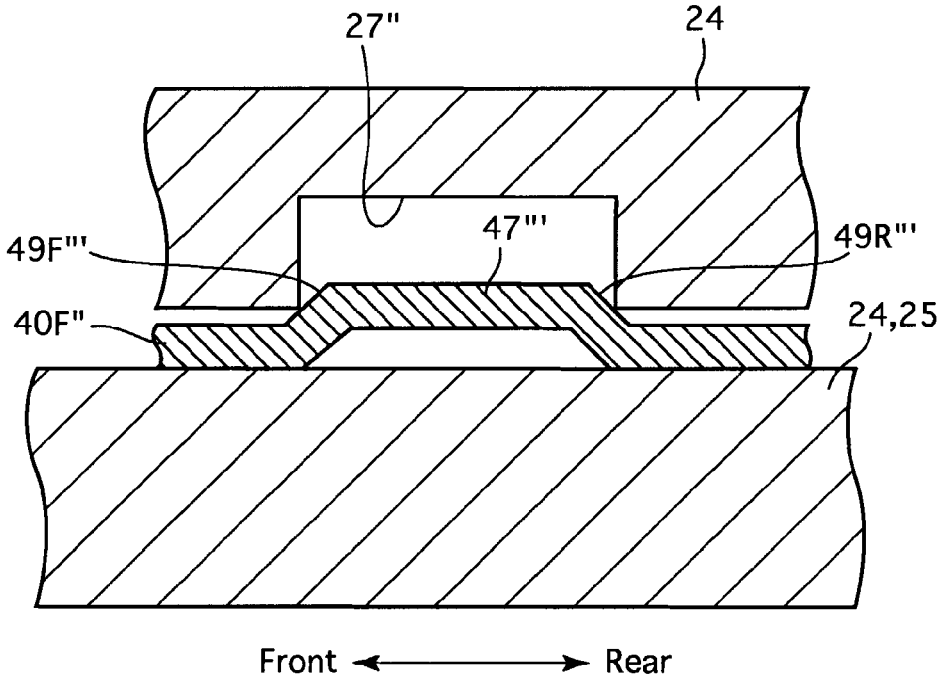
FIG. 18 is an enlarged cross sectional view similar to that of FIG. 17, showing a state of engagement between another embodiment of the engaging projection and the associated locking hole.

In addition, as shown in FIG. 18, each first contact 40F" can be provided with a locking protrusion 47'" instead of the locking protrusion 47". The locking protrusion 47'" is provided with a front inclined surface 49F'" and a rear inclined surface 49R'" which are in contact with a front edge and a rear edge of the associated locking hole 27", respectively. Additionally, although not shown in the drawings, the top surface of the locking protrusion 47'" of each first contact 40F" is in contact with the top surface of the associated locking hole 27".

The locking protrusion 47'" of each first contact 40F" is also applicable to each first contact 40F and each second contact 40R.

Although the locking protrusion (47, 48, 47" or 47'") of each contact is brought into contact with the associated locking hole (27, 28 or 27") in each of the above-illustrated embodiments and modified embodiments, it is possible to make the locking protrusion and the associated locking hole face each other with a slight clearance therebetween. In addition, this is also true with regard to the relationship between the locking protrusion (47, 48, 47" or 47'") of each contact and the top surface of the associated locking hole (27, 28 or 27").

The locking protrusion 47 of each first contact 40F and the locking protrusion 48 of each second contact 40R can be formed to be identical in cross sectional shape to the associated locking holes 27 and 28, respectively, so that front, rear, upper and lower surfaces of the locking protrusion 47 respectively come into contact with front, rear, upper and lower surfaces in the associated locking hole 27 while front, rear, upper and lower surfaces of the locking protrusion 48 respectively come into contact with front, rear, upper and lower surfaces in the associated locking hole 28 when each first contact 40F and each second contact 40R are inserted into the associated first contact support groove 26F and the associated second contact support groove 26R, respectively. According to this structure, the holding force for holding each first contact 40F by the associated locking hole 27 and the holding force for holding each second contact 40R by the associated locking hole 28 are improved. Similarly, the locking protrusion 76 of each contact 70 in the modified embodiment shown in FIG. 11 can be formed to be identical in cross sectional shape to the associated locking hole 27' so that front, rear, upper and lower surfaces of the locking protrusion 76 respectively come into contact with front, rear, upper and lower surfaces in the associated locking hole 27'.

If no burden upon the insulator 20 needs to be taken into consideration, all the locking holes 27 and 28 can be formed on the insulator 20 and all the locking protrusions 47 and 48 can be formed on the first and second contacts at the same positions in the forward/rearward direction. Likewise, all the locking holes 27' can be formed on the insulator 20' and the locking protrusions 76 can be formed on the contacts 70 at the same positions in the forward/rearward direction in the modified embodiment of the connector of FIG. 11.

In addition, each locking hole 27 and 28 can also be formed as a through-hole which extends through the associated partition wall 24 in the leftward/rightward direction, and each locking hole 27' can also be formed as a through-hole which extends through the associated locking hole 27' and the top plate portion 23' in the upward/downward direction.

In addition, the basic structure of the connector according to the present invention is not limited solely to the above-described embodiments and modified embodiments. For instance, the present invention can also be applied to a connector equipped with a sliding-type actuator.

Additionally, an object to be connected to each contact of the connector can also be a cable other than an FPC, e.g., a flexible flat cable (FFC).

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A connector to which an object is to be connected, comprising:

an insulator having at least one contact support groove; and at least one contact which is fixed to said insulator by being inserted into said contact support groove, said contact being contactable with said object after said object is inserted into said insulator, wherein said insulator includes at least one holding portion formed as one of a recess and a through-hole which is communicatively connected with said contact support groove, wherein said contact includes a locking protrusion which comes into engagement with said holding portion to hold said contact to said insulator when said contact is inserted into said contact support groove, wherein a plurality of said contact support grooves are arranged in a predetermined direction, wherein a plurality of said contacts are inserted into said plurality of contact support grooves, respectively, wherein a plurality of said holding portions are communicatively connected with said plurality of contact support grooves, respectively, and are provided at alternately different positions in a lengthwise direction of said plurality of contact support grooves to be arranged in a zigzag fashion, and wherein said locking protrusion is formed on each of said contacts, so that said locking protrusions of said contacts come into engagement with said holding portions when said contacts are inserted into said contact support grooves, respectively, and wherein a protrusion amount of a peak point of said locking protrusions is less than a depth of said holding portions such that said locking protrusions do not contact an inner surface of said holding portions.

2. The connector according to claim 1, wherein said locking protrusion protrudes from one of two lateral sides of said contact, and wherein said holding portion is formed on one of two lateral sides of said contact support groove which faces said one lateral side of said contact.

3. The connector according to claim 2, wherein said contact comprises:

a first arm and a second arm which face each other with a predetermined distance therebetween; and a resilient connecting portion which connects said first arm and said second arm to each other, wherein said connector includes an actuator which moves one end of said second arm toward said inserted object by pressing the other end of said second arm in a direction away from an adjacent one end of said first arm with said object being inserted in between the other end of said first arm and said one end of said second arm.

4. The connector according to claim 1, wherein a top surface of said locking protrusion faces a top surface of said holding portion while a bottom surface of said contact is in contact with a bottom of said contact support groove.

5. The connector according to claim 1, wherein said locking protrusion protrudes from one of a top surface and a bottom surface of said contact, and wherein said holding portion is formed on one of a top surface and a bottom surface of said contact support groove.

6. The connector according to claim 1, wherein an engaging portion is formed on said contact at a position different from a position of said locking protrusion in a lengthwise direction of said connector, wherein a surface of said locking protrusion which faces said engaging portion faces an inner surface of said holding portion, and wherein a surface of said engaging portion which faces said locking protrusion is in contact with said insulator.

7. The connector according to claim 3, wherein said actuator comprises at least one cam positioned between said adjacent end of said first arm and said other end of said second arm, a movement of said actuator relative to said insulator causing said cam to press said other end of said second arm to thereby move said one end of said second arm toward said other end of said first arm.

8. The connector according to claim 3, wherein said actuator comprises a pair of pivots which project in opposite directions from laterally opposite ends of said actuator, respectively, wherein said actuator is rotatable about said pair of pivots relative to said insulator.

9. A connector comprising:

an insulator having a plurality of contact support grooves; and a plurality of contacts which are fixed to said insulator by being inserted into said plurality of contact support grooves, respectively, each of said contacts having two prongs for holding an object which is to be connected to said contact therebetween, wherein said insulator includes a plurality of locking holes formed in said contact support grooves, respectively, and wherein each of said contacts includes a locking protrusion which comes into engagement with said locking hole formed in associated one of said contact support grooves when said contacts are inserted into said contact support grooves, respectively, wherein a plurality of said contact support grooves are arranged in a predetermined direction, wherein said plurality of said locking holes are communicatively connected with said plurality of contact support grooves, respectively, and are provided at alternately different positions in a lengthwise direction of said plurality of contact support grooves to be arranged in a zigzag fashion, wherein said locking protrusion is formed on each of said contacts, so that said locking protrusions of said contacts come into engagement with said locking holes when said contacts are inserted into said contact support grooves, respectively, and wherein a protrusion amount of a peak point of said locking protrusions is less than a depth of said locking holes such that said locking protrusions do not contact an inner surface of said locking holes.

* * * * *